US007594331B2

(12) United States Patent
Andrews et al.

(10) Patent No.: US 7,594,331 B2
(45) Date of Patent: Sep. 29, 2009

(54) METHOD OF PRODUCTION OF JOINING PROFILES FOR STRUCTURAL MEMBERS

(75) Inventors: William J. Andrews, Cambewarra (AU); Geoffrey Darmody, Worrigee (AU); Albert S. Hill, Murrietta, CA (US)

(73) Assignee: Wiltin Pty. Ltd., Nowra, NSW (AU)

( * ) Notice: Subject to any disclaimer, the term of this patent is extended or adjusted under 35 U.S.C. 154(b) by 161 days.

(21) Appl. No.: 11/483,714

(22) Filed: Jul. 10, 2006

(65) Prior Publication Data

US 2007/0107369 A1 May 17, 2007

Related U.S. Application Data

(60) Provisional application No. 60/780,099, filed on Mar. 8, 2006.

(51) Int. Cl.

| | |
|---|---|
| ***B21D 5/02*** | (2006.01) |
| ***B21D 22/00*** | (2006.01) |
| ***B21D 47/00*** | (2006.01) |
| ***B21J 7/16*** | (2006.01) |
| ***B23P 23/00*** | (2006.01) |
| ***E21D 11/22*** | (2006.01) |

(52) U.S. Cl. ..... 29/897.3; 29/37 R; 72/353.2; 72/354.2; 72/381; 72/394; 72/398; 403/363

(58) Field of Classification Search ..... 72/352, 72/353.2, 354.2, 381, 394, 398, 402; 29/897.3, 29/37 R; 403/363; 52/309.16
See application file for complete search history.

(56) References Cited

U.S. PATENT DOCUMENTS

| | | | | |
|---|---|---|---|---|
| 227,196 | A * | 5/1880 | Alexander | 72/396 |
| 1,711,445 | A * | 4/1929 | Burvenick | 72/58 |
| 1,766,098 | A * | 6/1930 | Booth | 72/58 |
| 2,173,721 | A | 9/1939 | McGee | |
| 2,515,841 | A * | 7/1950 | Stuart | 72/360 |
| 2,843,725 | A | 7/1958 | Granberg | |
| 2,966,708 | A | 1/1961 | Freeman, Jr. | |
| 3,160,280 | A | 12/1964 | Burch | |

(Continued)

FOREIGN PATENT DOCUMENTS

| | | |
|---|---|---|
| AU | 428738 | 10/1972 |

(Continued)

*Primary Examiner*—David P Bryant
*Assistant Examiner*—Alexander P Taousakis
(74) *Attorney, Agent, or Firm*—Stetina Brunda Garred & Brucker

(57) ABSTRACT

A method for forming a joining profile in a structural member comprises providing an assembly having a base member, a forming body and a pair of side anvils having profiles formed therewithin. The method further comprises mounting the structural member on the base member, advancing the forming body toward the structural member such that the structural member is clamped to the base member, urging the side anvils toward flanges of the structural member, forming a profile in each of the flanges, and engaging protrusions of the side anvils with the web such that opposing portions of the web are forced upwardly by the protrusions at locations adjacent to each one of the flange profiles in order to accommodate formation of the flange profiles in the structural member. Formation of the joining profiles in the structural members allows for detachable engagement thereof with another member having a corresponding mating profile.

20 Claims, 11 Drawing Sheets

U.S. PATENT DOCUMENTS

| | | | | |
|---|---|---|---|---|
| 3,217,452 | A | 11/1965 | Steele | |
| 3,234,697 | A | 2/1966 | Toti et al. | |
| 3,332,197 | A | 7/1967 | Hinkle | |
| 3,656,223 | A | 4/1972 | Maisenbacher | |
| 3,665,837 | A | 5/1972 | Balfanz, Jr. | |
| 3,685,863 | A | 8/1972 | Oetiker | |
| 3,719,980 | A | 3/1973 | Van Bussel | |
| 3,753,324 | A | 8/1973 | Puccio | |
| 3,834,212 | A * | 9/1974 | Roper | 72/354.2 |
| 3,845,601 | A | 11/1974 | Kostecky | |
| 3,861,101 | A | 1/1975 | Whisson | |
| 3,925,948 | A | 12/1975 | Sauer et al. | |
| 3,999,875 | A | 12/1976 | Simon | |
| 4,018,020 | A | 4/1977 | Sauer et al. | |
| 4,019,291 | A | 4/1977 | Ernst | |
| 4,074,487 | A | 2/1978 | Daniels et al. | |
| 4,272,930 | A | 6/1981 | Foster | |
| 4,364,212 | A | 12/1982 | Pearson et al. | |
| 4,397,127 | A | 8/1983 | Mieyal | |
| 4,709,517 | A | 12/1987 | Mitchell et al. | |
| 4,713,921 | A | 12/1987 | Minialoff et al. | |
| 4,734,971 | A | 4/1988 | Dupasquier | |
| 4,757,657 | A | 7/1988 | Mitchell et al. | |
| 4,760,682 | A | 8/1988 | King | |
| 4,798,029 | A | 1/1989 | Carlton | |
| 4,809,476 | A | 3/1989 | Satchell | |
| 4,854,096 | A | 8/1989 | Smolik | |
| 4,918,899 | A | 4/1990 | Karytinos | |
| 5,040,345 | A | 8/1991 | Gilmour | |
| 5,079,884 | A | 1/1992 | Menchetti | |
| 5,081,813 | A | 1/1992 | White | |
| 5,095,678 | A | 3/1992 | Murphy | |
| 5,127,760 | A | 7/1992 | Brady | |
| 5,203,132 | A | 4/1993 | Smolik | |
| 5,222,335 | A | 6/1993 | Petrecca | |
| 5,285,615 | A | 2/1994 | Gilmour | |
| 5,394,665 | A | 3/1995 | Johnson | |
| 5,497,591 | A | 3/1996 | Nelson | |
| 5,592,796 | A | 1/1997 | Landers | |
| 5,596,859 | A | 1/1997 | Horton et al. | |
| 5,600,991 | A | 2/1997 | Munzen | |
| 5,649,688 | A | 7/1997 | Baker | |
| 5,685,121 | A | 11/1997 | DeFrancesco et al. | |
| 5,692,405 | A | 12/1997 | Kirii | |
| 5,720,138 | A | 2/1998 | Johnson | |
| 5,729,950 | A | 3/1998 | Hardy | |
| 5,735,100 | A | 4/1998 | Campbell | |
| 5,797,233 | A | 8/1998 | Hascall | |
| 5,819,578 | A | 10/1998 | Codatto | |
| 5,930,968 | A | 8/1999 | Pullam | |
| 6,023,898 | A | 2/2000 | Josey | |
| 6,029,334 | A | 2/2000 | Hartley | |
| 6,032,504 | A | 3/2000 | Onat et al. | |
| 6,098,435 | A | 8/2000 | Takada | |
| 6,119,430 | A | 9/2000 | Nicholls | |
| 6,374,558 | B1 | 4/2002 | Surowiecki | |
| 6,401,423 | B1 | 6/2002 | Bergeron et al. | |
| 6,418,682 | B1 | 7/2002 | Rice | |
| 6,453,627 | B1 | 9/2002 | Powers | |
| 6,557,254 | B1 | 5/2003 | Johnson | |
| 6,568,138 | B1 | 5/2003 | Frost et al. | |
| 6,609,285 | B1 | 8/2003 | Kinney | |
| 6,647,691 | B2 | 11/2003 | Becker et al. | |
| 6,792,733 | B2 | 9/2004 | Wheeler et al. | |
| 6,871,470 | B1 | 3/2005 | Stover | |
| 6,964,079 | B2 | 11/2005 | Zimmer | |
| 6,983,569 | B1 | 1/2006 | Rosenberg | |
| 6,997,026 | B2 | 2/2006 | Fischer | |
| 7,086,265 | B2 | 8/2006 | Losch | |
| 7,127,862 | B2 | 10/2006 | Saldana | |
| RE39,462 | E | 1/2007 | Brady | |
| 2001/0017016 | A1 | 8/2001 | Rudduck | |
| 2003/0033770 | A1 | 2/2003 | Harel | |
| 2003/0089053 | A1 | 5/2003 | Elderson | |
| 2003/0145537 | A1 | 8/2003 | Bailey | |
| 2004/0035065 | A1 | 2/2004 | Orszulak et al. | |
| 2004/0055232 | A1 | 3/2004 | Jette | |
| 2004/0083665 | A1 | 5/2004 | Surowiecki | |
| 2004/0232290 | A1 | 11/2004 | Wilhelmsen et al. | |
| 2005/0034408 | A1 | 2/2005 | Palumbo et al. | |
| 2005/0079034 | A1 | 4/2005 | Maas | |
| 2005/0217344 | A1 | 10/2005 | Losch | |
| 2006/0065345 | A1 | 3/2006 | James et al. | |
| 2006/0144009 | A1 | 7/2006 | Attalla | |
| 2006/0185315 | A1 | 8/2006 | Walker | |
| 2006/0191227 | A1 | 8/2006 | Orszulak et al. | |
| 2006/0277841 | A1 | 12/2006 | Majusiak | |
| 2006/0283130 | A1 | 12/2006 | Andrews | |
| 2007/0011971 | A1 | 1/2007 | Sitkiewicz | |

FOREIGN PATENT DOCUMENTS

| | | | |
|---|---|---|---|
| AU | 494278 | | 7/1978 |
| AU | 5482090 | | 11/1990 |
| AU | B-14070/92 | | 10/1992 |
| AU | 642828 | | 10/1993 |
| AU | B-60570/96 | | 12/1996 |
| EP | 0 321 183 | A1 | 6/1989 |
| EP | 0752745 | A1 | 6/1996 |
| FR | 2870760 | A1 | 5/2004 |
| GB | 2169937 | | 3/1989 |
| JP | 52101819 | | 8/1977 |
| JP | 03293106 | | 10/2003 |
| JP | 2004197804 | A | 7/2004 |
| JP | 2006062078 | A | 3/2006 |
| LV | 0013363 | B | 10/2005 |
| NZ | 0198360 | | 9/1980 |
| WO | WO 8810344 | | 12/1988 |
| WO | WO 932-4712 | A1 | 12/1993 |
| WO | WO 9508409 | A1 | 3/1995 |
| WO | WO 972-3694 | A1 | 7/1997 |
| WO | WO 0014355 | A1 | 3/2000 |
| WO | WO 0071827 | A1 | 11/2000 |

* cited by examiner

METHOD OF PRODUCTION OF JOINING PROFILES FOR STRUCTURAL MEMBERS

CROSS-REFERENCE TO RELATED APPLICATIONS

The present application claims priority under 35 USC §119 to Australian Provisional Patent Application No. 2005907348, filed Dec. 30, 2005, and to Australian Provisional Patent Application No. 2005906274, filed Nov. 5, 2005, both of which are entitled METHOD OF PRODUCTION OF JOINING PROFILE FOR STRUCTURAL MEMBER, and is also related to U.S. patent application Ser. No. 09/979,214, filed May 14, 2002, entitled "STRUCTURAL MEMBERS AND JOINING ARRANGEMENTS THEREFOR", U.S. patent application Ser. No. 11/146,534, filed Jun. 7, 2005, entitled "STRUCTURAL MEMBERS WITH GRIPPING FEATURES AND JOINING ARRANGEMENTS THEREFOR", and U.S. Provisional Patent Application No. 60/780,099, filed Mar. 8, 2006, entitled "FIRE RATED WALL STRUCTURE", the entire contents of each application being expressly incorporated by reference herein.

STATEMENT RE: FEDERALLY SPONSORED RESEARCH/DEVELOPMENT (Not Applicable)

BACKGROUND

The present invention relates generally to joining systems and, more particularly, to a method of forming joining profiles in structural frames such as metallic frames having a channel shaped cross section. Such structural frames may be used in the construction of wall assemblies such as partitioning walls and curtain walls.

In building construction, conventional wall fabrication techniques employ the use of upper and lower headers that are disposed in spaced relationship to one another. The upper and lower headers may be attached to the ceiling and floor portions of a building structure and are interconnected with a plurality of stud members disposed in spaced, parallel relationship to one another. The stud members are typically connected to the top and bottom headers with mechanical fasteners such as nails, screws and the like.

The framing, which is comprised of the upper and lower headers and the stud members, may be of wooden or metallic construction. Panels such as drywall, gypsum board, sheetrock, and the like are then installed on opposing sides of the framing in order to complete the basic wall structure. Unfortunately, traditional wall construction suffers from several drawbacks include the time consuming nature of such traditional wall construction methods and resultant high costs.

Metallic framing systems typically employ the use of lightweight steel stud members which are generally channel shaped or U-shaped. The stud members are attachable at opposing ends to horizontally oriented top and bottom members. The top and bottom members are, in turn, secured to the building structure adjacent the ceiling and floor. In this regard, a metallic framing system comprises a series of spaced apart steel stud members engaged to the top and bottom plate members and which includes wall board which is attached to opposing sides of the metallic faming system.

In conventional construction methodology, the frames may be assembled on the ground with the top and bottom members being disposed in spaced apart relationship. The stud members are then connected to the top and bottom members by engaging the ends of the stud with screws or other suitable fasteners. Because the metallic framing system is dependent upon fasteners for interconnecting the stud members to the top and bottom members, the framing system is generally structurally weak when the stud members are initially engaged to the top and bottom members prior to fastener installation. The framing system does not achieve full strength until wall board is affixed to the frame and therefore provides insufficient rigidity until fasteners are inserted.

Another method of securing the stud members to the top and bottom members involve the use of a tab and slot arrangement wherein tabs disposed on extreme ends of the top and bottom members engage corresponding slots in the stud members. Such engagement is facilitated by manually urging (i.e., with a hammer) the tabs so that they are reoriented at an angular orientation relative to the stud members which thereby locks the stud members against the top and bottom members.

Unfortunately, such method of interconnecting the stud members to the top and bottom members requires additional material to form the top and bottom members. Furthermore, the reorienting or bending of the tabs into the locking position requires additional labor and is therefore relatively time consuming. Although the tab and slot method of connecting the stud members to the top and bottom members is generally effective in securing such members, the amount of time required to bend the tab a total of four times for each stud member represents a significant drawback which detracts from the overall utility of this type of metallic framing system.

Another method of constructing a metallic framing system from stud members and top and bottom members involves the use of cooperating formations in each of the components. The formations consist of a securing notch formed in the walls of the mating stud member and top and bottom members. In order to facilitate the positioning of the stud member, the walls of the top and bottom members include an upturned lip formed at a location where the stud member mates with the top and bottom members.

Unfortunately, the additional materials required to form such lip increases overall material costs and necessitates the use of a securing clip which further adds to labor and assembly costs. Another drawback associated with such methodology of connection is the low strength of the framing system due to the minimal amount of engagement between the mating components. More specifically, the limited engagement between the mating components minimizes the overall resistance of the framing system to rotation, twisting and separation of the stud member and top and bottom plate members.

Another problem associated with prior art metallic framing systems is a result of irregularities in floor to ceiling heights. More particularly, in building construction, poor concrete finishing and/or irregularities in the height of the ceiling structure necessitates the time-consuming task of cutting and fitting individual stud members to fit between the top and bottom members mounted to the ceiling and floor. Ideally, the spacing between the floor and the ceiling structure is preferably constant such that the stud members may generally be of the same length.

However, irregularities in spacing often occur such that each of the stud members must be custom fit. Furthermore, windows and/or doors installed in many wall structures require that the stud members must be cut and fit on a trial-and-error basis to accommodate the specific window or door size. In other words, a plurality of custom-fit stud members must be first cut to an approximate length and test-fit and then often trimmed in order to form the framing above and below the windows and/or doors. As may be appreciated, such individual cutting, fitting and trimming of the stud members is time consuming and adds additional labor costs to the overall wall installation.

A further deficiency associated with conventional wall structures is the rigid or non-adaptive nature of the wall structure to changes in ceiling height as a result of settling of the building foundation and/or building movement such as may be caused by seismic activity or creeping of load-carrying beams in the building structure over time. The same drawbacks described above associated with relative movement between the framing system and the wall board is present in ceiling movement or building settling.

As can be seen, there exists a need in the art for a method of producing joining profiles in metallic framing for a wall structure such that structural members which make up the metallic framing may be securely fastened in a convenient and time efficient manner. It should be pointed out that it is well known in the art that relatively thin or light gauge steel is particularly prone to tearing and unwanted deformation during manipulation or forming thereof. In the case of producing joining profiles in light gauge steel, simultaneous stretching and compression operations are performed on different planes of a structural member.

The combined effects of the conflicting stretching and compression forces during forming of a joining profile greatly increases the propensity of the steel material to tear and produce unwanted deformations. Therefore, there exists a need in the art for a method of introducing such joining profiles in structural members fabricated of light gauge steel which overcomes propensities for unwanted tearing and deformation during simultaneous stretching and compression of the structural members. Furthermore, there exists a need in the art for introducing joining profiles via a method that provides for the manipulation of light gauge structural steel members at very high speeds such that such structural members may be mass-produced quickly, economically, and efficiently.

BRIEF SUMMARY

The above-mentioned deficiencies and drawbacks associated with prior art wall framing methods are specifically addressed and alleviated by the method disclosed herein. More specifically, provided herein is a method for introducing a joining profile into a structural member such (e.g., stud) that the structural member may detachably engage another member (e.g., horizontal member, header or footer)having a corresponding mating profile. The structural member may be configured as a channel shaped cross-section having a web with a pair of flanges extending outwardly therefrom.

The method comprises an ordered sequence of steps that includes the use of a forming assembly and which entails mounting the structural member on the forming assembly, advancing a mid anvil toward the structural member until the structural member is clamped to a base member, urging a pair of side anvils toward a respective one of the flanges of the structural member, and forming the joining profile in the flanges while engaging protrusions underneath the web of the structural member in order to force the web upwardly to accommodate formation of the joining profile.

The forming assembly preferably comprises the base member and includes a forming body and/or mid anvil and which has at least one, and preferably, a pair of the side anvils each having an anvil profile formed therein. The side anvil includes a vertically oriented protrusion disposed adjacent to the anvil profile. Likewise, the mid anvil has opposing faces each including anvil profiles formed thereon. Preferably, the anvil profiles of the mid anvil are formed complementary to the anvil profiles of the side anvils.

The structural member is mounted on the base member or base plate of the forming assembly by placing the web thereon. A hydraulic cylinder or hydraulic actuator may be used to actuate the forming body in alternating retraction and advancement of the mid anvil toward the structural member until the web is clamped between the forming body (i.e., mid anvil) and the base of the forming body member. Hydraulic cylinders may also be utilized to actuate the side anvils toward a corresponding one of the flanges until the anvil profiles engage the flanges. In this manner, at least one and, more preferably, a pair of parallel, spaced joining profiles are formed in each of the flanges of the structural member.

Such joining profiles are introduced by clamping the flanges between the mid anvil and the side anvils. As was earlier mentioned, the joining profiles are preferably formed with a gender opposite that of the gender of the anvil profiles. The protrusions simultaneously engage an underside of the web adjacent the anvil profiles while the side anvils are advanced into the flanges. In this manner, the protrusions force localized portions of the web upwardly (when under compression) into areas adjacent to each one of the joining profiles and thereby direct excess compressed material into a receptacle area that, in turn, provides stress relief to the web which minimizes distortions that may otherwise occur into the structural member.

The method may further include the step of cutting the structural member along a direction transverse to a longitudinal axis of the structural member. Such cutting may be facilitated by advancing a vertically reciprocative cutting assembly or cutting blade (e.g., knife) downwardly into the structural member while the web is clamped between the forming body (i.e., mid anvil) and the base member. Ideally, the pair of joining profiles are formed in each of the flanges in spaced relation to one another such that each of the joining profiles is located proximate ends of the newly formed pair of structural members.

The anvil profiles may be V-shaped such that the joining profile is also V-shaped. However, it is contemplated that the anvil profiles may be provided in any size, shape and configuration. In addition, the joining profiles may be formed in either parallel or normal orientations relative to the longitudinal axis of the structural member. The joining profile thereby results in a recess formed in an external face of the flange and a projective formed in an opposing internal face of the flange opposite the recess.

BRIEF DESCRIPTION OF THE DRAWINGS

These and other features and advantages of the various embodiments disclosed herein will be better understood with respect to the following description and drawings in which like numbers refer to like parts throughout and in which.

DETAILED DESCRIPTION

Figure 1:
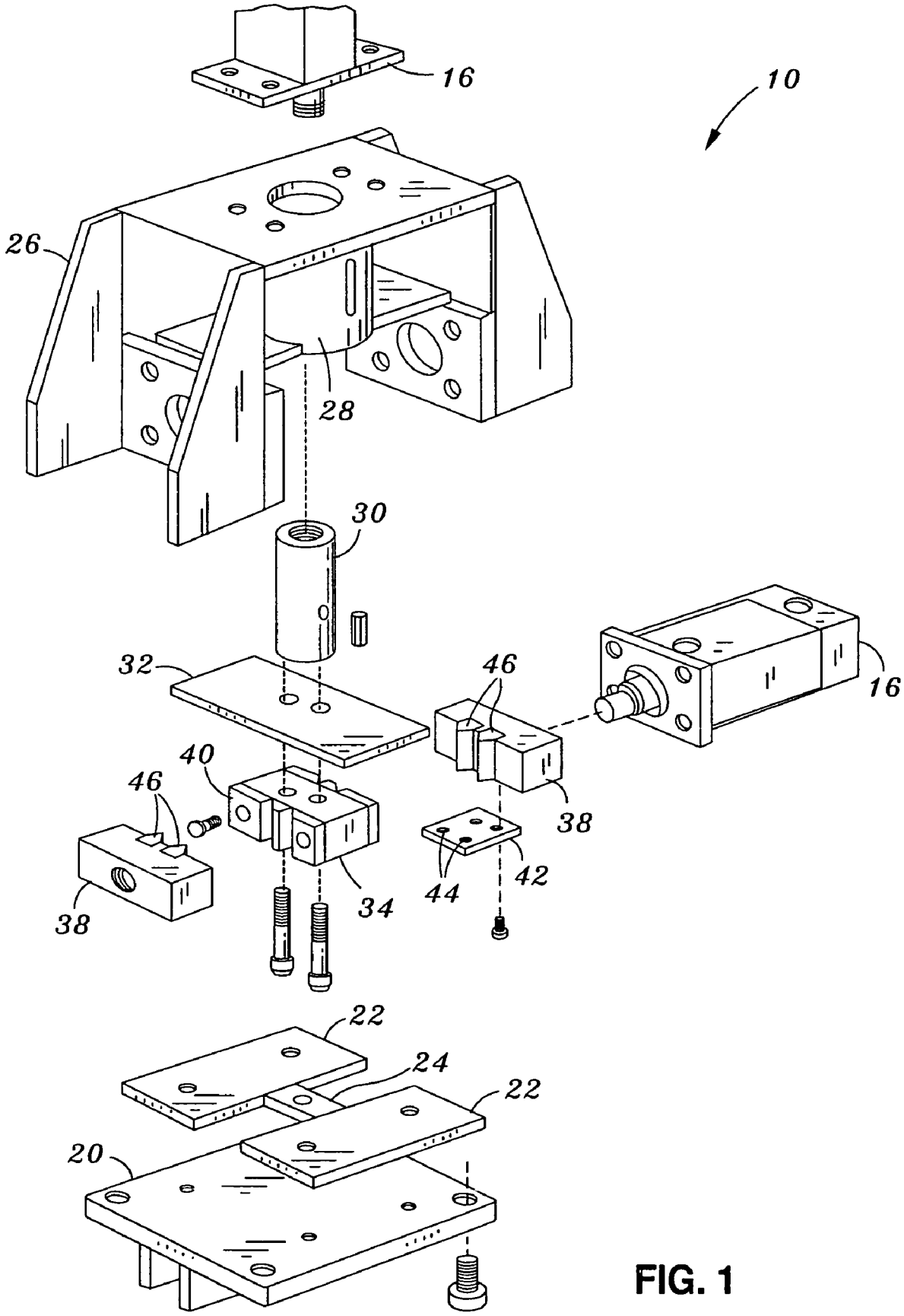
FIG. 1 is an exploded perspective view of a forming assembly adapted for introducing a joining profile into a structural member wherein the forming assembly is shown without a cutting assembly for cutting or shearing the structural member.

Referring now to the drawings wherein the showings are for purposes of illustrating the present invention and not for purposes of limiting the same, shown in the figures is a forming assembly 10 as may be used for introducing joining profiles 84 in structural members 70 such that the structural members 70 may detachably engage another member having a corresponding mating profile. Advantageously, the present invention provides a method by which the forming assembly 10 may be utilized to provide an improved, efficient and economic method for introducing such joining profiles 84 into structural members 70 in mass production.

The method may be performed in a two-step or three-step process wherein certain steps may be sequentially and/or simultaneously performed. In this regard, the method of formation of the joining profiles 84 provides a clamping step wherein the structural member 70 is clamped to the forming assembly 10 followed by, or coincident with, a forming step wherein the joining profiles 84 are formed in the structural member 70. Importantly, the method of formation provides a depression 92 in the structural member 70 adjacent each of the joining profiles 84 in order to lead and direct excess material into a receptacle relief 54 area to provide a natural response for compression and stretching of the structural member 70 which thereby avoids distortion of the structural member 70.

Furthermore, the method of the present invention may optionally include a cutting step wherein the structural member 70 may be cut into at least two pieces following introduction of joining profiles 84 in the structural member 70. Ideally, the joining profiles 84 are formed within opposing pairs of flanges 76 of the structural member 70. A pair of the joining profiles 84 is preferably formed in each of the flanges such that the joining profiles 84 are preferably spaced apart. In this manner, the structural member 70 may be split between the pairs during the cutting step. The method disclosed herein provides for mass production of structural members 70 while minimizing manufacturing steps such as additional forming steps with a resultant decrease in production time and cost.

Figure 17:
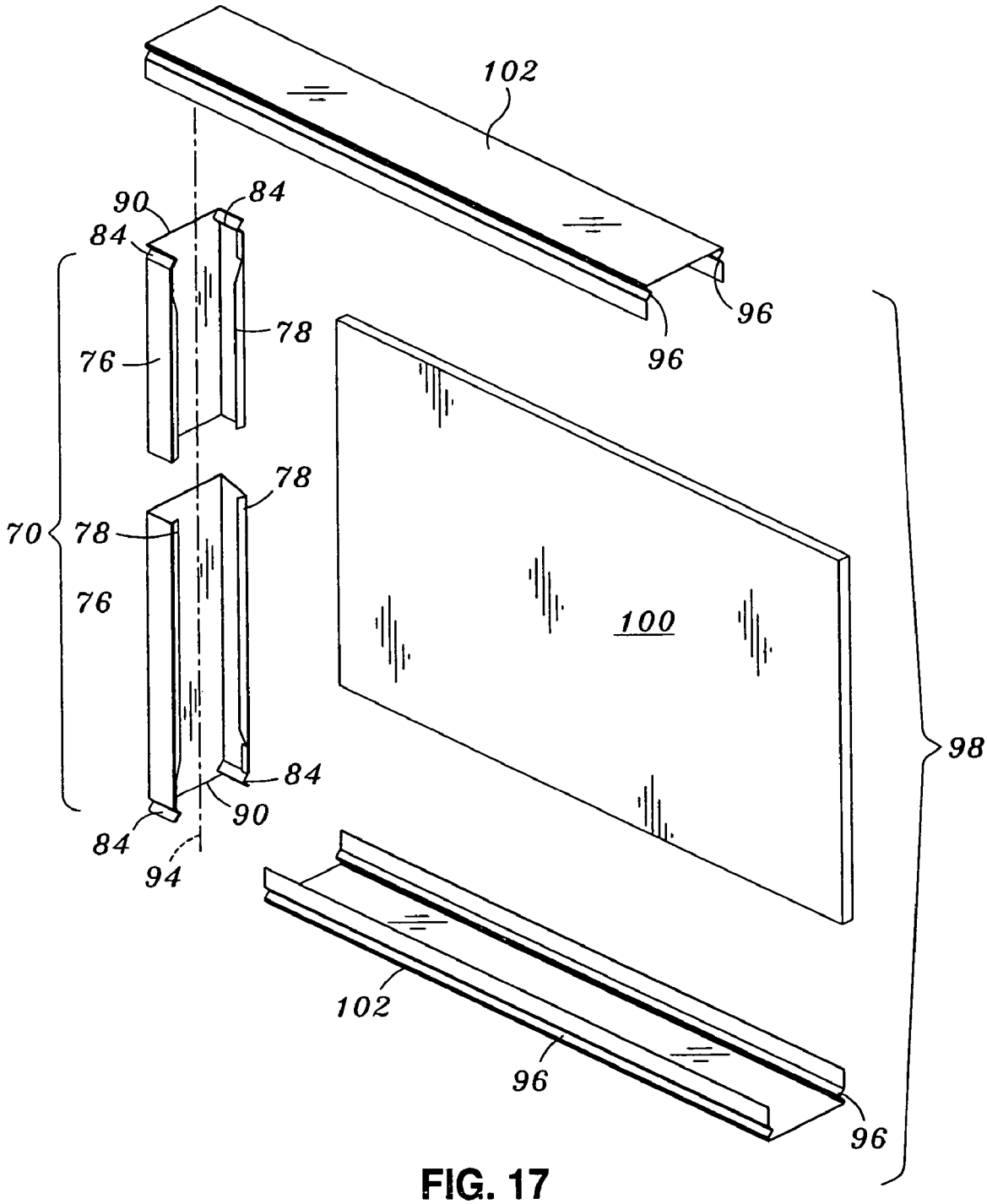
FIG. 17 is an exploded view of a wall structure employing structural members having the joining profiles formed therewithin such that the structural members may detachably engage another member having a corresponding mating profile.
Figure 18:
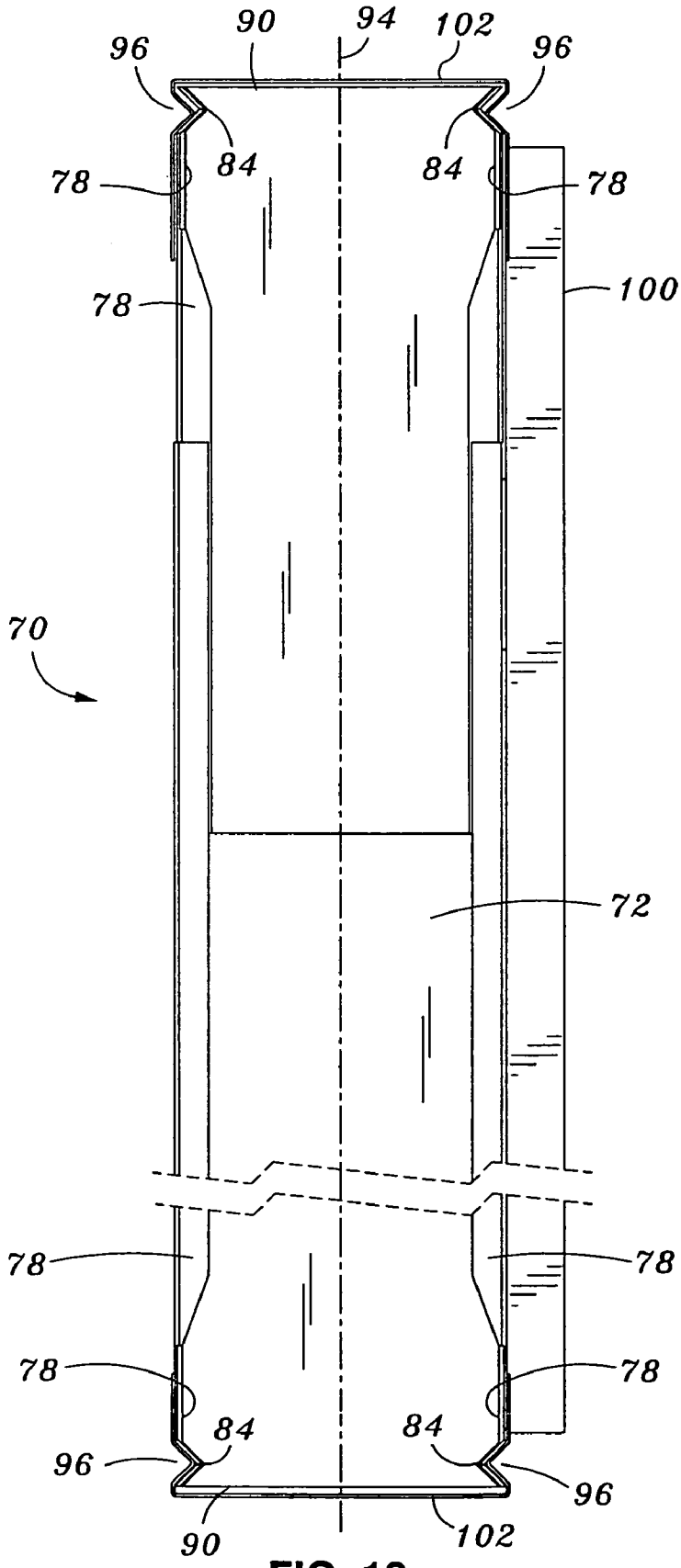
FIG. 18 is an end elevation view of the wall structure of FIG. 17 and illustrating the detachable engagement of a vertically oriented structural member with a horizontally oriented structural member via engagement of the joining profiles formed in the respective structural members.

Referring now to FIGS. 17 and 18, shown is a wall assembly 98 which may utilize structural members 70 of the type that are formed with joining profiles 84 using the methods disclosed herein. As can be seen, the wall assembly 98 includes a plurality of the structural members 70 and may have a panel member 100 secured thereto. At extreme ends 90 of the vertically oriented structural members 70 can be seen the joining profiles 84. The joining profiles 84 are specifically configured to detachably engage corresponding mating profiles 96 formed lengthwise along upper and lower horizontal members 102 to which the vertically oriented structural members 70 may be engaged.

As can be seen, the upper and lower horizontal members 102 are preferably disposed in spaced, parallel relation to one another and may be mounted to a floor and a ceiling of a building. The vertically oriented structural members 70 are interconnected to the upper and lower horizontal members 102. As is well known in the building construction arts, vertically oriented structural members 70 are generally provided in predefined spaced intervals and are connected to the upper and lower horizontal members 102 in order to provide a means for attaching panel members 100 such as drywall or wall board to form the wall assembly 98.

As can be seen in FIG. 18, each one of the upper and lower horizontal members 102 generally may have a channel shaped cross-section. The channel shaped cross-section is formed by a web 72 having flanges 76 extending outwardly therefrom. A pair of opposing and inwardly directed male features extend continuously along longitudinal edges 36 of the upper and lower horizontal members 102. The male features may be provided in a V-shaped cross-section which is configured to engage with the joining profiles 84 formed in ends 90 of the vertically oriented structural members 70.

The structural members 70 may also have a channel shaped cross-section with opposing terminus ends 90. As best seen in FIG. 17, a telescopic mechanism may optionally be incorporated into each of the vertically oriented structural members 70 in order to adapt for changes in spacing between the upper and lower horizontal members 102 such as may occur during differential heating and/or cooling of the metallic structure relative to the non-metallic panel member 100. An upper portion of the panel member 100 may be slideably engaged to the structural members 70 while a lower portion may be fixedly secured thereto via mechanical fasteners such as sheet metal screws or drywall screws. In this manner, the length of the metallic structural members 70 may expand and retract relative to the panel members 100. Such relative movement between the structural members 70 and the panel member 100 may be the result of a fire generating excessive heat in a room contained by the wall assembly, or may result from building movement such as may occur during seismic activity. Additionally, the relative expansion or contraction of the structural member 70 may result from settling of the building over time.

Figure 2:
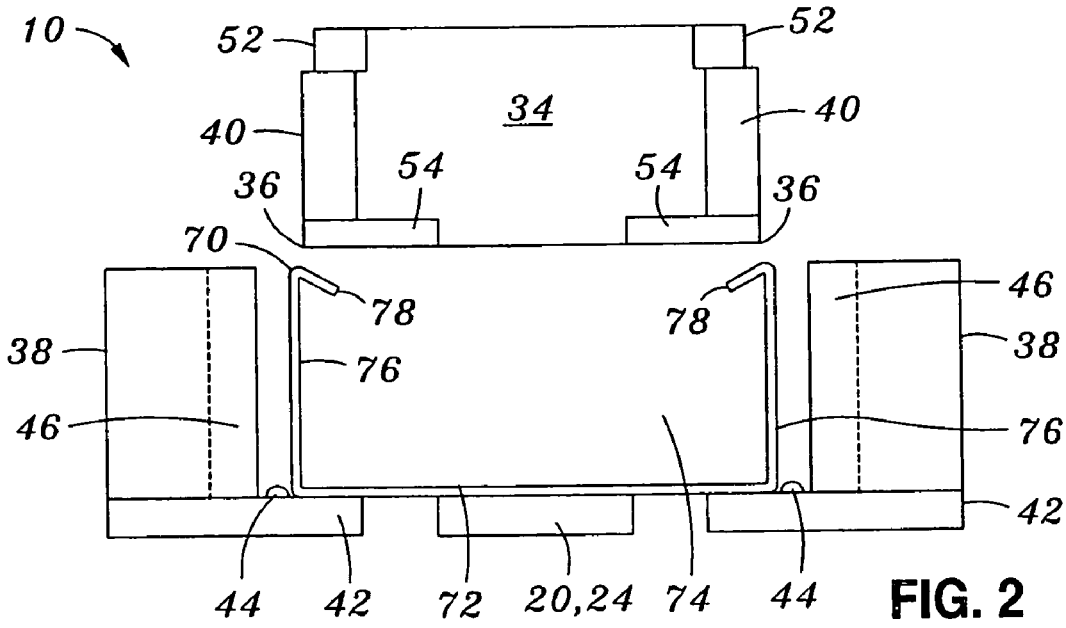
FIG. 2 is an end view of the forming assembly shown in FIG. 1 and illustrating a forming body in a retracted position relative to a structural member prior to forming of the joining profile therein.
Figure 3:
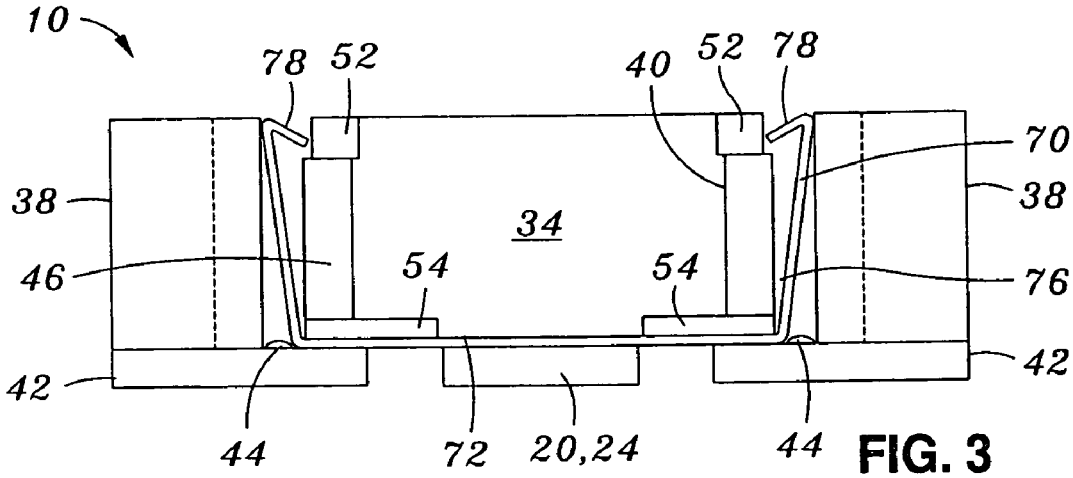
FIG. 3 is an end view of the forming assembly shown in FIG. 2 illustrating a mid anvil advanced toward the structural member wherein the mid anvil clamps the structural member to a base member of the assembly prior to forming the joining profile.
Figure 4:
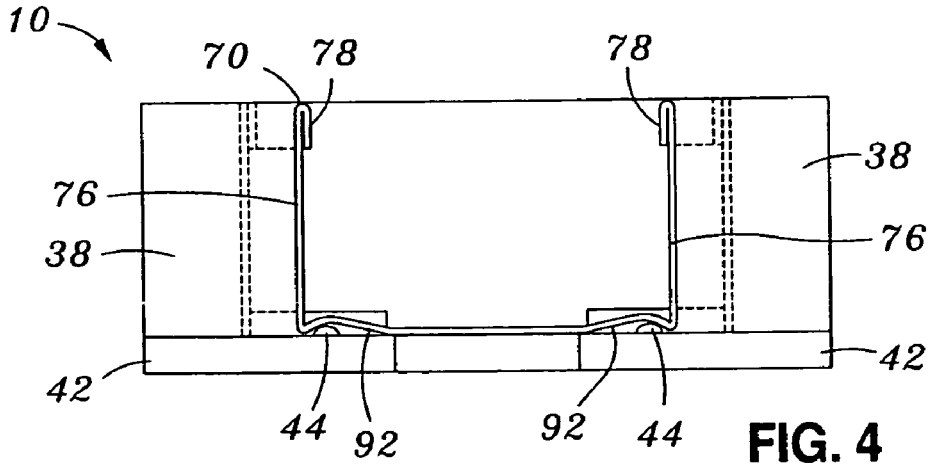
FIG. 4 is an end view of the forming assembly of FIG. 2 and illustrating the mid anvil directly engaged to the structural member and further illustrating a pair of side anvils advanced toward and engaging flanges of the structural member during formation of the joining profile therewithin.

Referring back to FIG. 1, shown is the forming assembly 10 which may be used in introducing joining profiles 84 into structural members 70. The forming assembly 10 may include a forming body 26 which is reciprocativelyZz moveable via an activation system such as a hydraulic actuator or hydraulic cylinder 16. The forming body 26 may be advanced and retracted in the directions shown in FIGS. 8-10 in order to effectuate formation of the joining profile 84 as shown in FIGS. 2-4. The forming body 26 may include a bush 28 which engages a spigot 30 which, in turn, engages a control plate 32 for mounting a mid anvil 34. The mid anvil 34 is specifically provided with formations 48 for introducing joining profiles 84 in the structural member 70.

The forming assembly 10 further includes at least one and, more preferably, a pair of side anvils 38 which cooperate with the mid anvil 34 to introduce the joining profiles 84 into the structural member 70. The forming assembly 10 may further comprise a base member 20 to which may be mounted a pair of mid plates 22 and a base plate 24 interposed between the mid plates 22. In such an arrangement, the base member 20 may receive and supports the mid plates 22 and the base plate 24. Each of the side anvils 38 may be engaged to or mounted upon a seat 42.

Figure 7:
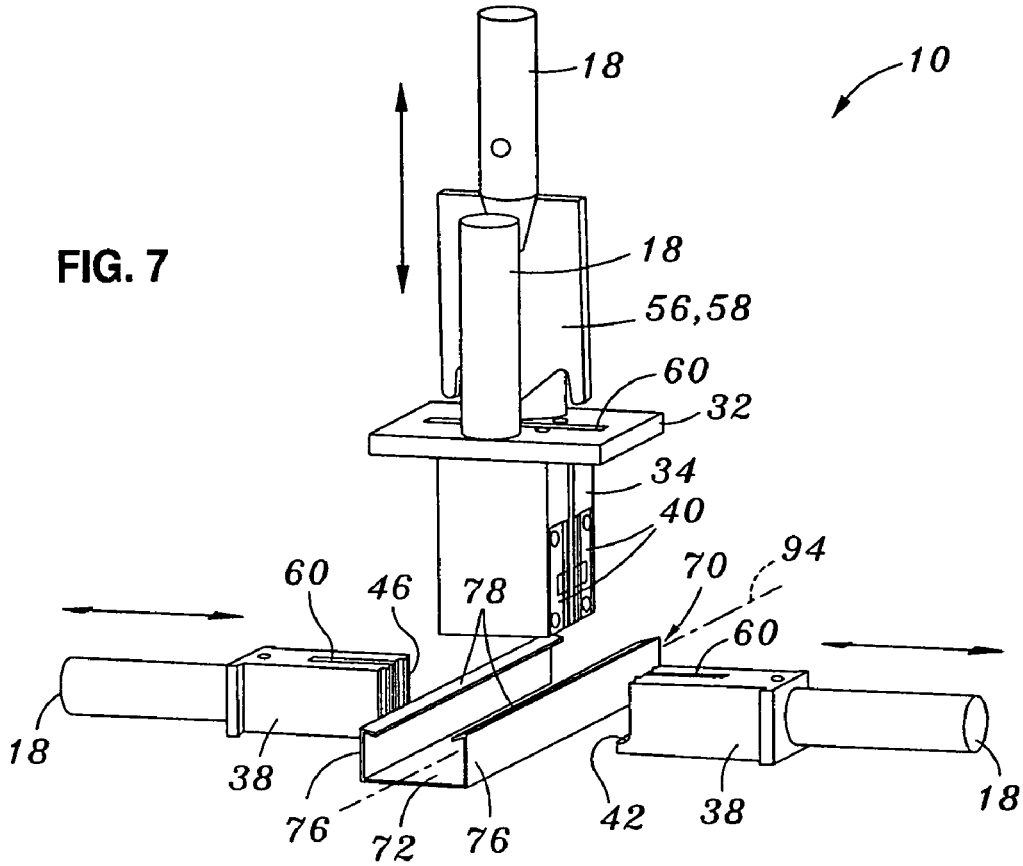
FIG. 7 is a perspective view of the various forming components in their respective retracted positions.
Figure 8:
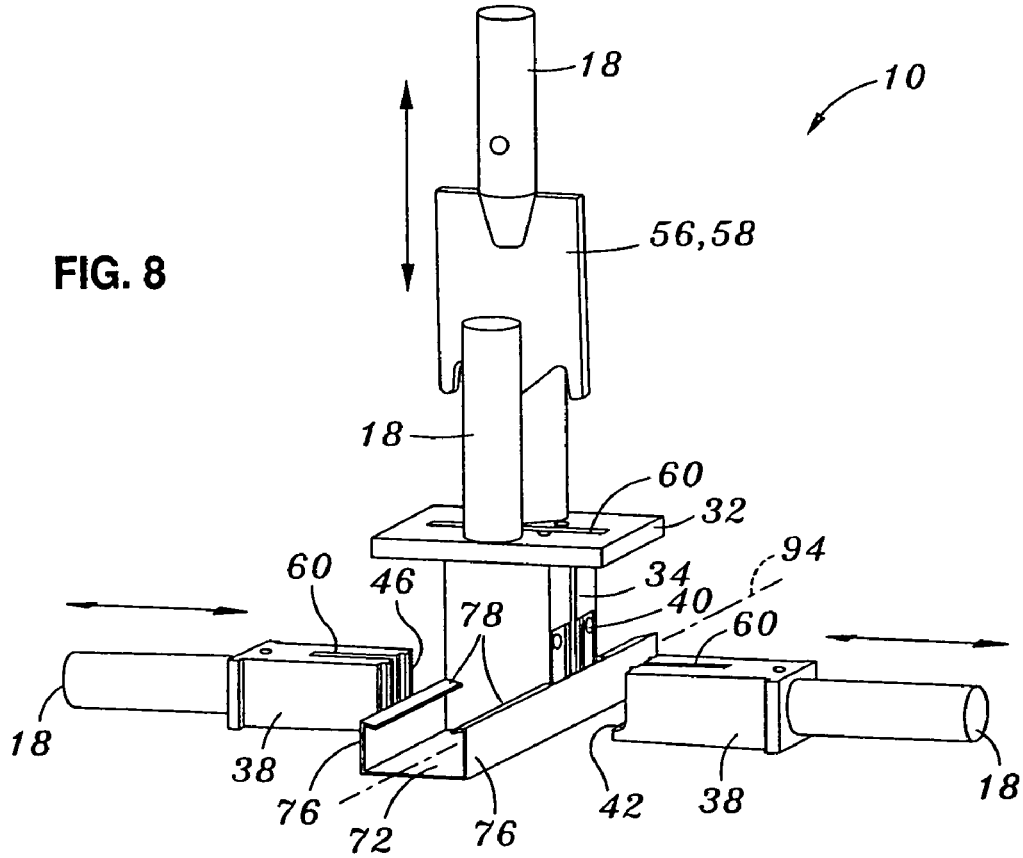
FIG. 8 is a perspective view of the forming station showing the engagement of the mid anvil to the structural member and indicating directions along which the mid anvil and the side anvils advance during forming of the joining profiles.
Figure 9:
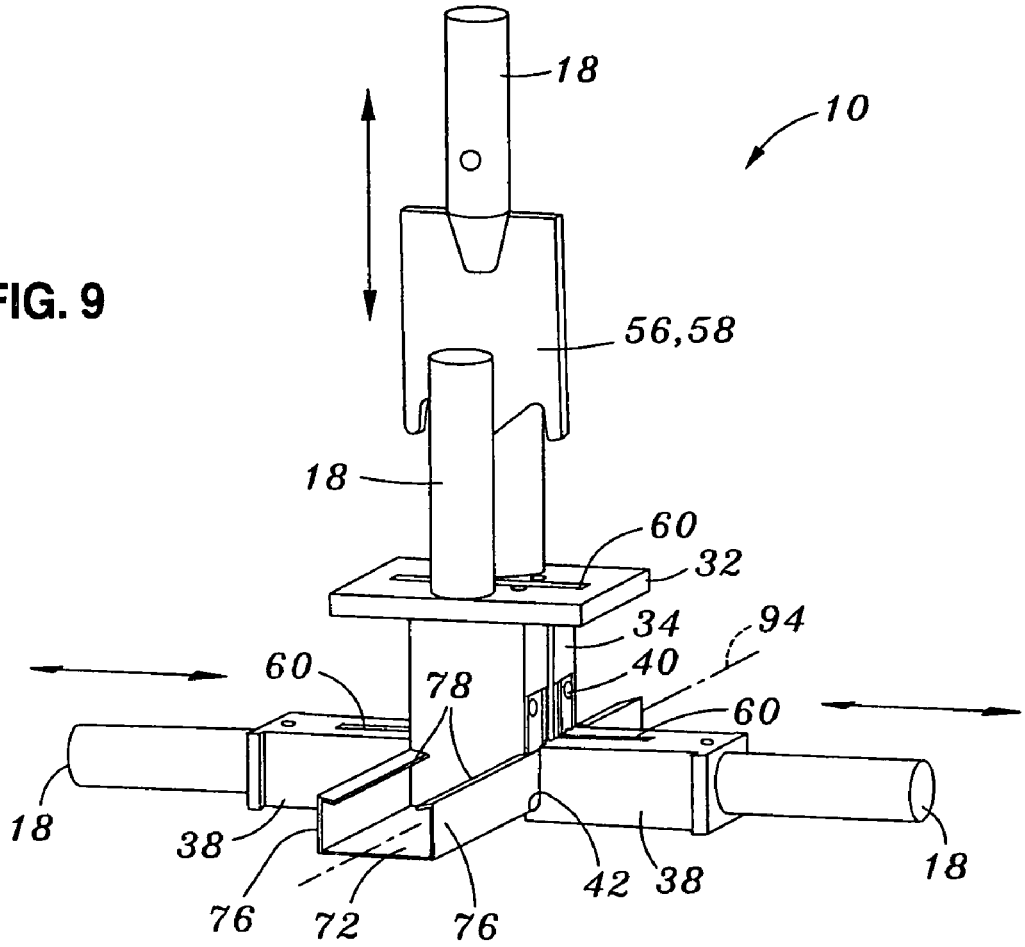
FIG. 9 is a perspective view of the forming station illustrating the mid anvil and side anvils directly engaged to the structural member and illustrating a cutting blade in a retracted position.

Importantly, the seat 42 may include at least one and, more preferably, a pair of protrusions 44 which assist in the formation 48 of the joining profiles 84 in a manner to be described in more detail below. Each of the side anvils 38 may be reciprocatively moved into and out of engagement with the structural member 70 via the hydraulic cylinder 16 similar to that which is used to move the forming body 26. In this regard, the side anvils 38 are specifically configured to move in a direction perpendicular to the direction of movement of the forming body 26. FIGS. 7-9 illustrate each of the side anvils 38 mounted to a rod 18 which may be interconnected to a hydraulic actuator. FIGS. 2-5 illustrate the movement of the side anvils 38 toward the structural member 70. The forming body 26 may be mounted to one and, more preferably, a pair of rods 18 which may be interconnected to a hydraulic cylinder 16.

As can be seen in FIG. 2, each of the side anvils 38 are initially retracted away from the structural member 70 while the mid anvil 34 is advanced downwardly toward the structural member 70. The side anvils 38 are positioned laterally outwardly relative to a pair of flanges 76 of the structural member 70. As shown, each of the side anvils 38 may include the seat 42 and at least one of the protrusions 44 extending upwardly therefrom. The protrusion 44 may preferably be a dome shaped protrusion 44 although other configurations of the protrusion 44 are contemplated in order to effectuate production of localized depressions 92 in the structural member 70 adjacent the joining profiles 84. Preferably, each of the protrusions 44 of the respective side anvils 38 are in alignment with one another in a direction normal or perpendicular to the flanges 76 of the structural member 70.

Shown in FIG. 3 is an additional end view of the forming assembly 10 wherein the forming body 26 and/or mid anvil 34 is shown advanced toward the structural member 70. The structural member 70 is preferably a generally channel shaped cross-section comprised of a horizontally oriented web 72 having the flanges 76 extending laterally outwardly (i.e., upwardly) therefrom. Each of the flanges 76 may further include a flange return 78 extending laterally inwardly from respective ones of the flanges 76. As can be seen in FIG. 3, the mid anvil 34 may be advanced toward the structural member 70 until the web 72 is clamped between the mid anvil 34 and the base member 20. In this regard, the web 72 and flanges 76 of the structural member 70 define an open channel space 74 to which the mid anvil 34 is specifically sized and configured to occupy.

As can be seen in FIGS. 2 and 3, the mid anvil 34 may optionally include a pair of notches 52 disposed on opposite sides of the mid anvil 34 at upper ends thereof. Such notches 52 are specifically sized and configured to bend or fold the flange returns 78 downwardly into overlapping engagement with respective ones of the flanges 76 when the side anvils 38 are directly engaged to the flanges 76. As shown in FIG. 3, the protrusions 44 engage respective ones of the flanges 76 of the structural member 70. The protrusions 44 are initially brought into touching engagement with the flanges 76 prior to the next stage of the forming process.

In FIG. 4, shown is an end view of the forming assembly 10 wherein the forming body 26 is completely advanced toward the structural member 70 such that the mid anvil 34 clamps the web 72 to the base member 20. The side anvils 38 are also shown completely advanced toward the flanges 76 of the structural member 70 in order to introduce the joining profiles 84 thereinto. Likewise, the flange returns 78 may be bent into overlapping relationship with the flanges 76 in order to provide a reinforced edge of the structural member 70 at locations adjacent to the joining profiles 84. Likewise, the protrusions 44 are engaged with the web 72 on opposing sides of the structural member 70 while the side anvils 38 are urged toward the flanges 76 such that a portion of the web 72 is forced upwardly by the protrusion 44 in order to accommodate (i.e., allow stretching of) the structural member 70 during formation of the joining profiles 84.

In summary, the sequence of steps comprises initially mounting the member on the base member 20, advancing the forming body 26 or mid anvil 34 toward the member until the web 72 is clamped to the base member 20, urging the side anvil(s) 38 toward an external face(s) 80 of the flange(s) 76 along a direction perpendicular to a plane of the flange(s) 76 such that the side anvil(s) 38 engage the flange(s) 76 thus forming the joining profile(s) 84 in the flange 76. As is illustrated in the figures, the joining profiles 84 formed in the structural member 70 have a gender or shape which is opposite to that of the gender formed in the side anvils 38.

More specifically, each of the side anvils 38 has at least one anvil profile 46 formed therein. Hence, the joining profile 84 will have a configuration which mirrors the anvil profile 46 of the side anvil 38. During formation 48 of the joining profile 84, the protrusions 44 are engaged with the web 72 in an area adjacent to the joining profile 84. Movement of the forming body 26 or mid anvil 34 as well as movement of the side anvils 38 is effectuated by action of the hydraulic cylinders 16. The side anvils 38 may preferably advance concurrently toward the flanges 76 in order to prevent lateral movement of the structural member 70 relative to the base member 20.

As shown in FIGS. 2-4, the mid anvil 34 may include longitudinal edges 36 at a lower end 90 thereof. Such edges 36 are specifically configured to engage the flange returns 78 of the structural member 70 as the mid anvil 34 initially contacts the flanges 76. Simultaneously, the protrusions 44 of the side anvils 38 initially engage the flanges 76 adjacent to the web 72. As the mid anvil 34 continues downwardly, the edges 36 thereof contact the flange returns 78 causing the flanges 76 to partially spread apart or deflect laterally outwardly in order to clear a path for the mid anvil 34 as it travels downwardly toward the web 72. Simultaneously, the edges 36 cause the flange returns 78 to deform downwardly in order to initiate overlapping engagement of the flange returns 78 with the flanges 76.

Figure 5:
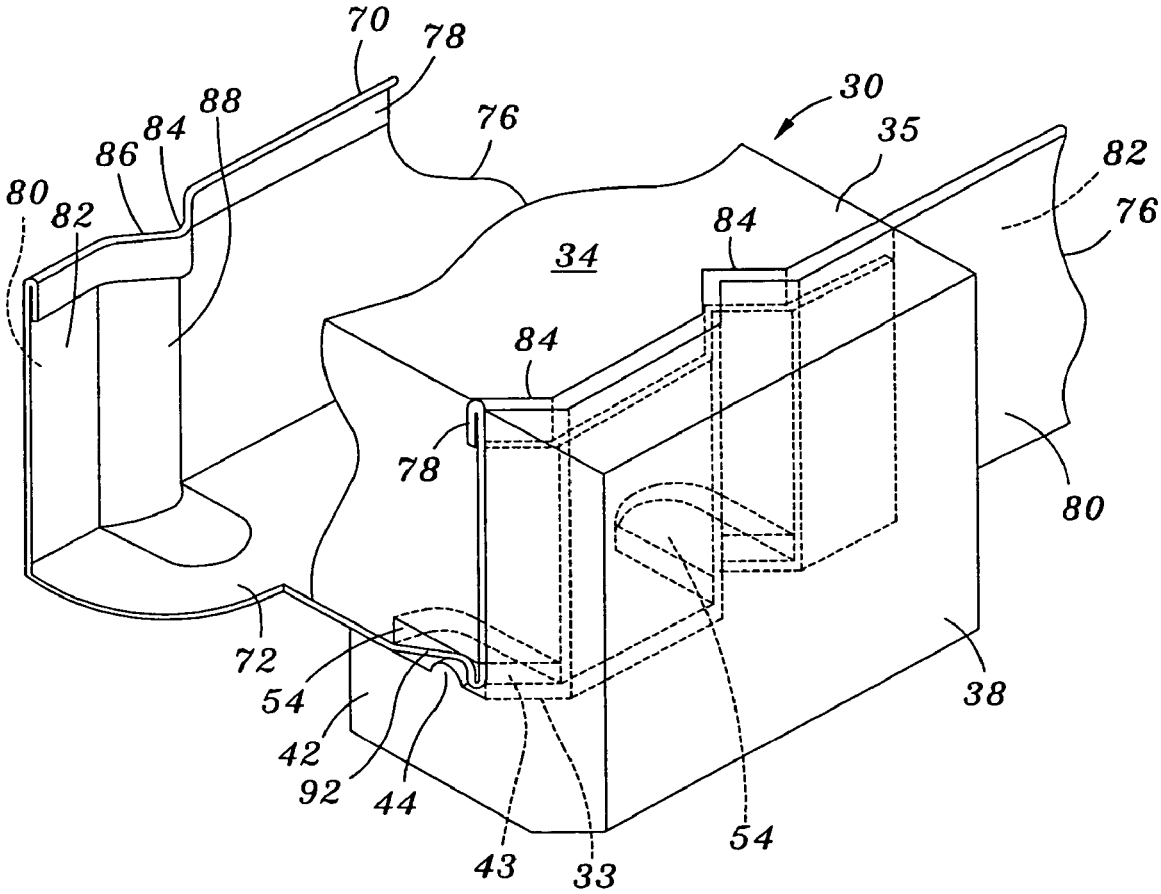
FIG. 5 is a perspective view of one of the side anvils directly engaged to one of the flanges of the structural member during formation of the joining profile.

Each of the side anvils 38 cooperates with the mid anvil 34 to form opposing joining profiles 84 in the structural member 70. As can be seen in FIG. 5, a pair of joining profiles 84 may be formed in each flange 76 of the structural member 70. However, it is contemplated that any number of joining profiles 84 may be formed in the structural member 70. For example, a single joining profile 84 may be in one of the flanges 76 of the structural member 70. However, formation 48 of the pair of joining profiles 84 in each of the opposing flanges 76 facilitates efficient mass production of structural members 70 as the structural member 70 may be split between the joining profiles 84 after forming in order to produce a pair of structural members 70 each having a joining profile 84 formed adjacent at least one of the respective ends 90 thereof.

Referring more particularly now to FIG. 4, shown is the forming assembly 10 in an end view wherein the side anvils 38 are directly engaged to the flanges 76. As can be seen in FIG. 4, a relief 54 may optionally be provided in a bottom portion of the mid anvil 34 at opposing sides thereof. Such reliefs 54 are preferably aligned with each of the anvil profiles 46 of the mid anvil 34 and side anvils 38. Additionally, the reliefs 54 in the mid anvils 34 are preferably aligned with the protrusions 44 such that the web 72 may be forced upwardly by the protrusions 44 during formation 48 of the joining profiles 84. In this regard, the protrusions 44 advance and retract in concert with the side anvils 38 in a direction perpendicular to a longitudinal axis 94 of the structural member 70. As was earlier mentioned, each of the protrusions 44 provides a response to compression and stretching of the metallic structural member 70 during forming of the joining profiles 84 by providing a path of resistance to thereby avoid distortion of the completed structural member 70.

Referring now to FIG. 5, shown in perspective is a partial view of the forming assembly 10 wherein the mid anvil 34 and one of the side anvils 38 has one of the flanges 76 clamped therebetween. The mid anvil 34 clamps the web 72 against the base member 20 while the side anvil 38 is shown laterally advanced to its maximum extent to complete one of the joining profiles 84 in the structural member 70. FIG. 5 further illustrates the joining profile 84 which comprises a recess 86 formed on an external face 80 of the flange 76 and a projection 88 formed on an internal face 82 of the flange 76 opposite the recess 86. Also shown in FIG. 5 is the flange return 78 which is folded downwardly against the flange 76 in order to provide reinforcement along the edges 36 of the structural member 70.

At an intersection of the flange 76 with the web 72, a depression 92 is provided in the web 72 in order to accommodate formation 48 of the joining profiles 84 without undue distortion of the structural member 70. The side anvil 38 can be seen mounted on or integrally formed with the seat 42 and which has one and, more preferably, a pair of protrusions 44 formed on the seat 42 in order to facilitate formation 48 of the reliefs 54. At an upper portion of the mid anvil 34 can be seen a notch 52 extending along a lateral side thereof. The notch 52 may be provided to facilitate overlapping of the flange return 78 with the flange 76.

As can be seen in the figures, each of the mid anvil 34 and side anvils 38 includes anvil profiles 46 formed therein. The anvil profiles 46 may be V-shaped although various other shapes of the anvil profiles 46 are contemplated. The anvil profiles 46 of the mid anvil 34 are preferably formed complementary to (i.e., opposite to) the corresponding anvil profiles 46 formed in the side anvils 38. In this regard, the anvil profile 46 of the mid anvil 34 opposes the anvil profiles 46 of the side anvils 38. Although the configuration of the anvil profiles 46 illustrates inwardly directed joining profiles 84 as shown in FIG. 5, it is contemplated that the anvil profiles 46 in the mid anvil 34 and side anvils 38 may be configured to introduce outwardly directed joining profiles 84 in the structural member 70.

Furthermore, although the anvil profiles 46 are shown as being generally V-shaped, it is contemplated that the anvil profiles 46 may be generally rounded or have various alternative shapes that are specifically configured to mate with corresponding mating profiles formed in another member in the manner shown in FIG. 17. However, regardless of the configuration of the joining profiles 84, the gender or direction of protrusion of each of the anvil profiles 46 is preferably such that a joining profile 84 of opposite gender is formed in the structural member 70.

Referring briefly still to FIG. 5, although the joining profile 84 is shown as being oriented perpendicularly relative to the longitudinal axis 94 of the structural member 70, it is contemplated that the forming assembly 10 comprising the mid anvil 34 and side anvils 38 may be configured such that the joining profiles 84 are formed in either parallel and/or normal orientations relative to the longitudinal axis 94 of the structural member 70. Further in this regard, FIG. 5 illustrates the joining profile 84 formed along a substantial portion of the flange 76. More specifically, the structural member 70 flange 76 defines a height extending from the web 72.

The joining profile 84 is preferably formed to extend along a substantial portion of the flange 76 height in order to facilitate detachable engagement of the structural member 70 to a corresponding mating profile 96 in another member. For example, as shown in FIGS. 17 and 18, each of the forming profiles is preferably located proximate the web 72 and extends along a substantial portion of the flange 76 height. In addition, each of the joining profiles 84 as shown in FIGS. 17 and 18 is preferably formed at a location adjacent an end 90 of the structural member 70 in order to enhance the structural integrity of the engagement between the structural member 70 and another member such as the horizontally oriented member.

By locating the joining profile 84 adjacent at least one end 90 of each of the structural members 70, the corresponding mating profile 96 which extends substantially continuously along a length of the upper and lower horizontal members 102 resists excessive outward deflection of the flanges 76 of the such horizontal members 102 which reduces the risk of inadvertent disengagement or disconnection between the vertically oriented structural member 70 and the upper and lower horizontal members 102 of a wall assembly 98 such as that which is shown in FIGS. 17 and 18. Furthermore, it is contemplated that each of the joining profiles 84 formed in opposing flanges 76 of the structural member 70 are formed at equal distances from the web 72 such that the joining profiles 84 are substantially aligned with one another. Such alignment of the joining profiles 84 facilitates engagement with a corresponding mating profile 96 in a another member.

Figure 6:
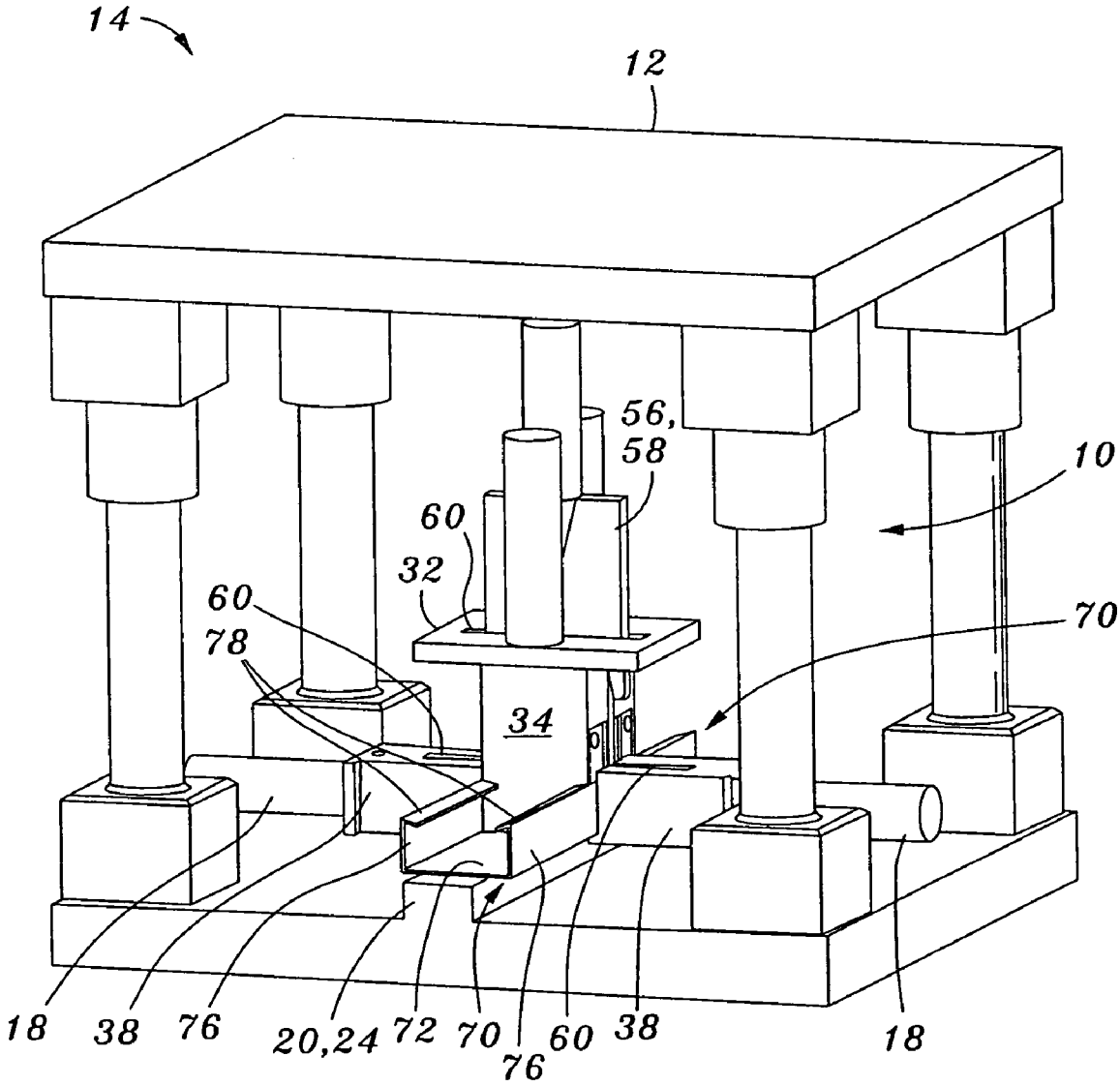
FIG. 6 is a perspective view of the forming assembly mounted in a mounting frame as may be used in a method for forming joining profiles in the structural member.

Referring to FIG. 6, shown is the forming assembly 10 retained in a mounting frame 12 wherein the mounting frame 12 includes at least one and, more preferably, a plurality of hydraulic and/or electrical actuators which are interconnected to the side anvils 38 and which assist in advancement and retraction thereof for forming the joining profiles 84. The structural member 70 may be placed on the base member 20 in preparation for the formation 48 steps. The forming station 14 comprises the side anvils 38 which advance and retract along the rods 18. The side anvils 38 selectively engage opposing flanges 76 of the structural member 70 following clamping of the member between the mid anvil 34 and the base member 20.

Optionally, the forming assembly 10 includes a cutting assembly 56 that is separately reciprocative in relation to movement of the mid anvil 34 and/or forming body 26. The cutting assembly 56 may be moveable along an axis that is parallel to the movement of the mid anvil 34 and may be separably activated by a hydraulic cylinder 16. The cutting assembly 56 may include a cutting blade 58 or similar cutting element which is advanceable through grooves 60 formed in the control plate 32 and in the mid anvil 34. Likewise, grooves 60 may also be formed in each of the side anvils 38 in order to accommodate the cutting blade 58 therein.

FIGS. 7-10 illustrate a sequence whereby the joining profiles 84 may be formed and the structural member 70 is thereafter cut into two pieces. FIG. 7 is an exploded perspective view of the forming assembly 10 isolated from the forming station 14 and showing the side anvils 38 and the mid anvil 34 retracted away from the structural member 70. Furthermore, the cutting assembly 56 is shown in a retracted state. In FIG. 8, the mid anvil 34 is shown advanced toward the structural member 70. As the mid anvil 34 advances past the flange returns 78, the flanges 76 are thereby bent slightly outwardly while the flange returns 78 are deformed slightly downwardly as shown in FIG. 3. More specifically, the flanges 76 bend outwardly away from the mid anvil 34 as it travels past the flange returns 78 and into direct engagement with the web 72 whereby the mid anvil 34 clamps the web 72 to the base member 20. The side anvils 38 are shown retracted away from the structural member 70 during clamping of the mid anvil 34 to the web 72.

FIG. 9 is an exploded perspective view of the forming assembly 10 wherein the mid anvil 34 is advanced into contact with the web 72 and the side anvils 38 are both advanced into contact with the flanges 76. In this step, the joining profiles 84 are formed by clamping the flanges 76 between the side anvils 38 and the mid anvil 34. Likewise, the flange returns 78 may be completely bent over into direct overlapping engagement with respective ones of the flanges 76. Furthermore, the protrusions 44 of each of the side anvils 38 are urged underneath the web 72 such that the web 72 is forced upwardly into the reliefs 54 formed in the mid anvil 34 in order to accommodate stretching of excess compressed material in the structural member 70.

Figure 10:
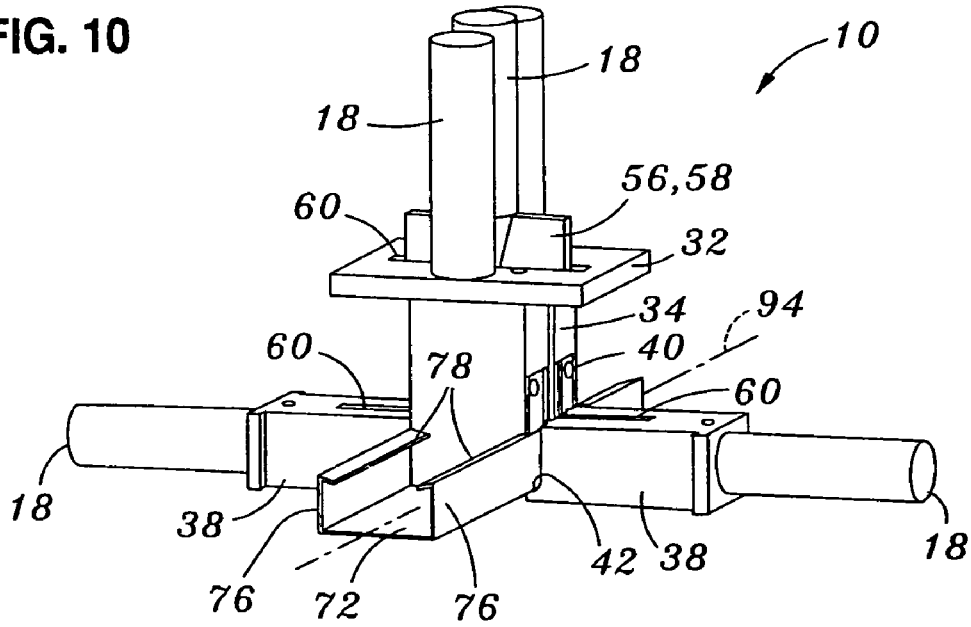
FIG. 10 is a perspective view of the forming station illustrating the mid anvil and both side anvils and the cutting blade advanced into the structural member.

FIG. 10 illustrates the cutting assembly 56 advanced downwardly in order to effectuate splitting or cutting of the structural member 70 into two pieces. As best seen in FIG. 8, the cutting assembly 56 may include the cutting blade 58 which may have a generally non-linear cutting edge 36. More specifically, the cutting edge 36 may define a generally inverted W-shape that is complementary to the channel shape of the structural member 70. In this manner, the cutting edge 36 accommodates substantially simultaneous cutting of the flanges 76 and web 72. Following cutting of the structural member 70, the cutting assembly 56 may be retracted away from the structural members 70 as are the side anvils 38 and mid anvil 34 thereby freeing the structural member 70 from the forming assembly 10. The method may be repeated by mounting a new unformed structural member 70 onto the forming assembly 10 to form joining profiles 84 thereinto optionally followed by a cutting step.

Figure 11:
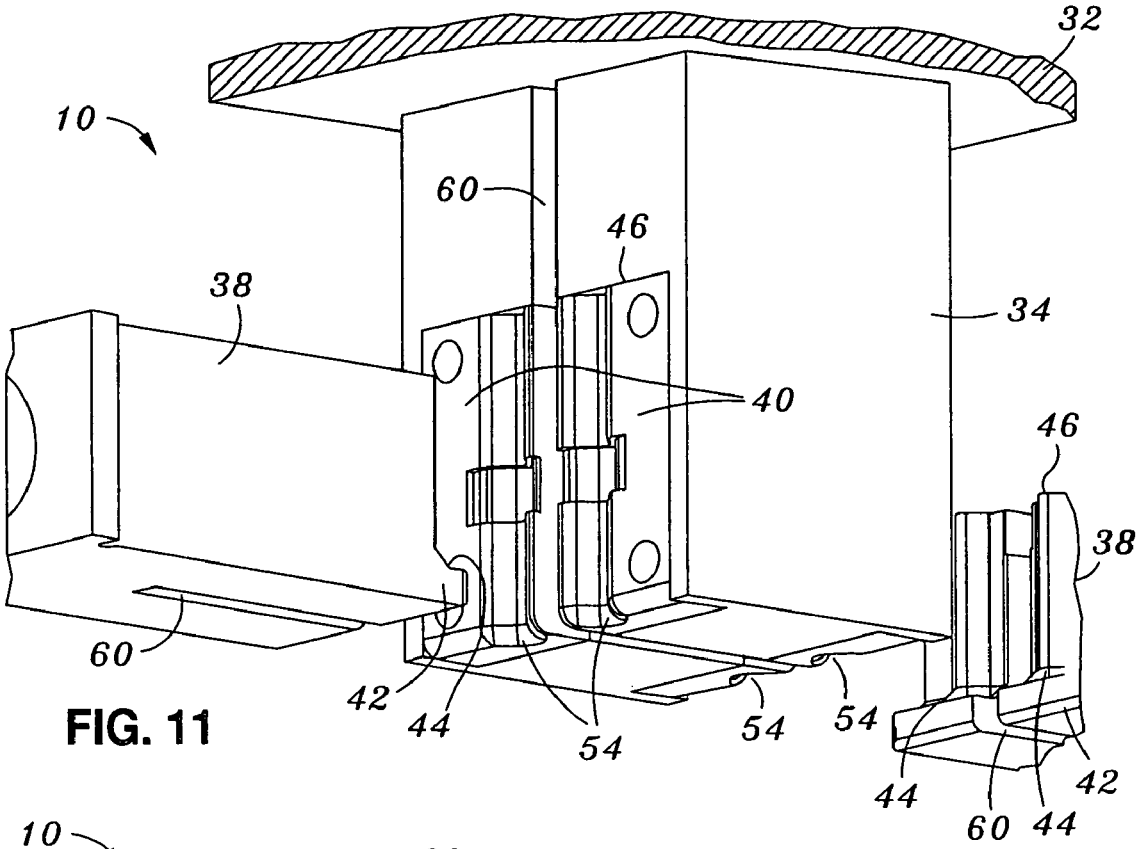
FIG. 11 is an enlarged perspective view of the pair of side anvils and a mid anvil for forming the joining profiles.
Figure 12:
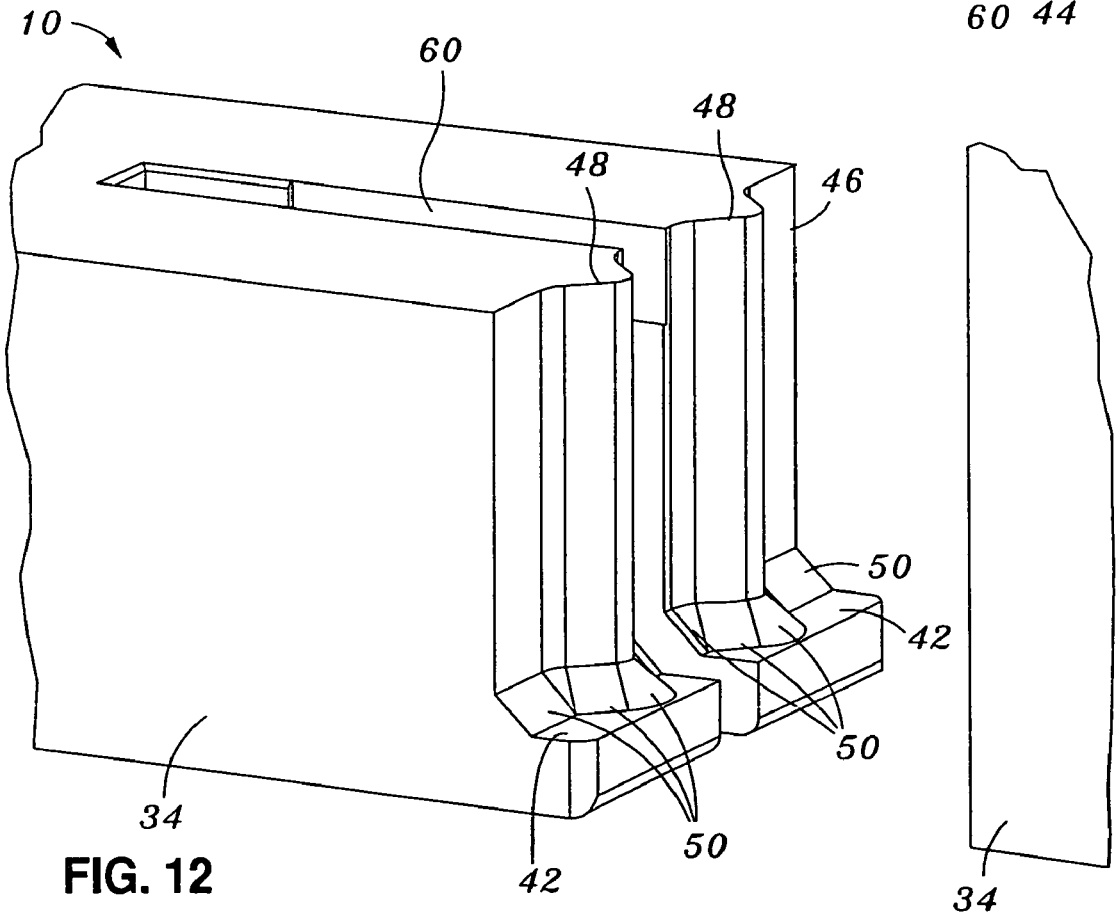
FIG. 12 is an enlarged perspective view of a pair of profiles and a groove as may be formed in each of the side anvils.
Figure 13:
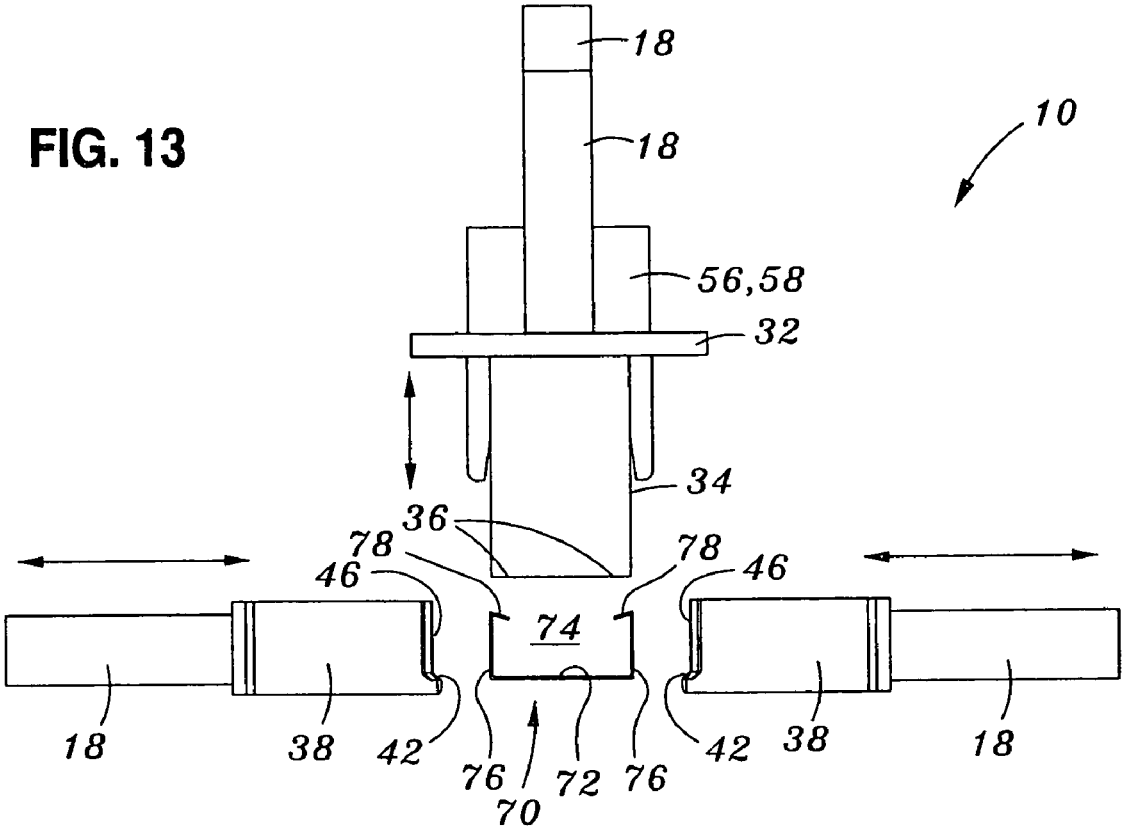
FIG. 13 is an exploded end view of the forming assembly shown in FIG. 9 wherein the side anvils and cutting assembly are disengaged from the structural member.

FIG. 12 is an enlarged perspective view of the mid anvil 34 and side anvils 38 illustrating a groove 60 formed therein which is preferably sized to facilitate the cutting blade 58. Shown in FIG. 11 is a profile plate 40 which may be mounted to opposing sides of the mid anvil 34 and which are preferably formed complementary to the anvil profiles 46 formed in the side anvils 38. More specifically, each one of anvil profiles 46 comprises at least one and, more preferably, a pair of parallel, aligned formation 48 extending vertically along a length thereof.

In the enlarged perspective view of FIG. 12, formations 48 can be seen formed in the side anvils 38. The formations 48 may include V-shaped features extending along a substantial vertical length thereof down to the seat 42 of the side anvil 38. The groove 60 can be seen extending through and bisecting the side anvil 38 in order to accommodate the cutting assembly 56. The groove 60 divides the side anvils 38 into separate bifurcated forming profiles.

In addition, shown in FIG. 12 are the anvil profiles 46 which include ramped surfaces 50 that may be formed at an acute angle. Corresponding ramped surfaces 50 of opposite gender are preferably formed in the mid anvil 34. The series of ramped surfaces 50 provide a smooth transition of the joining profiles 84 from the flange 76 to the web 72 of the structural member 70. In this regard, the ramped surfaces 50 leads material in a similar way toward protrusions 44 shown in FIG. 5 and causes excess material to fold and accommodate the compression process. Furthermore, this action prevents formation 48 of sharp corners which may act as stress risers that can result in cracking of the structural members 70 over time due to induced stresses.

FIGS. 13-16 illustrate progressive movements of the forming assembly 10 as was described above with reference to FIGS. 8-10. As can be seen in the FIGS. 13-16, the side anvils 38 include the anvil profiles 46 which advance toward and retract away from the opposing flanges 76 of the structural member 70 along opposing directions indicated by the laterally-oriented arrows. Likewise, the mid anvil 34 is configured to advance toward and retract away from the structural member 70 along a direction indicated by the vertically oriented arrow. As the mid anvil 34 advances toward the structural member 70, edges 36 thereof respectively engage flange returns 78 which causes the flange returns 78 to bend in the region of contact with the edges 36 clearing a path for the mid anvil 34 downwardly toward the web 72 of the structural member 70.

Figure 14:
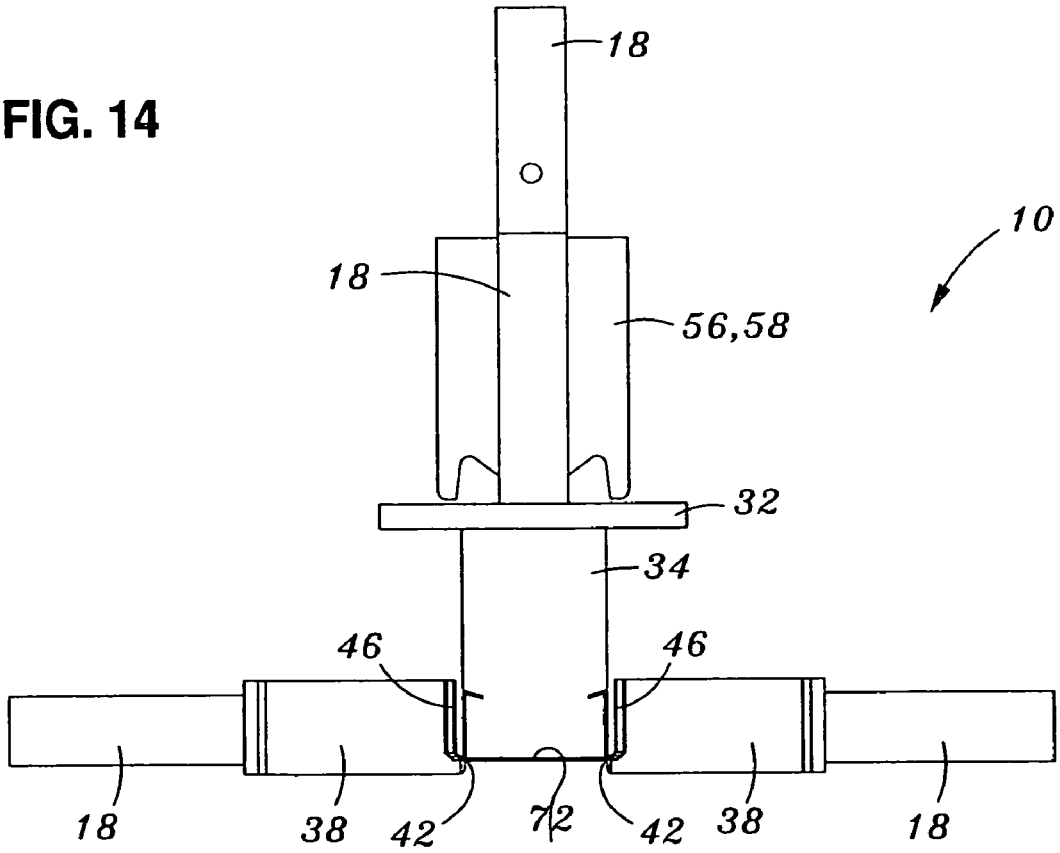
FIG. 14 is an end view of the side anvils and mid anvil prior to direct engagement thereof with the structural member and illustrating the cutting blade in a retracted position.
Figure 15:
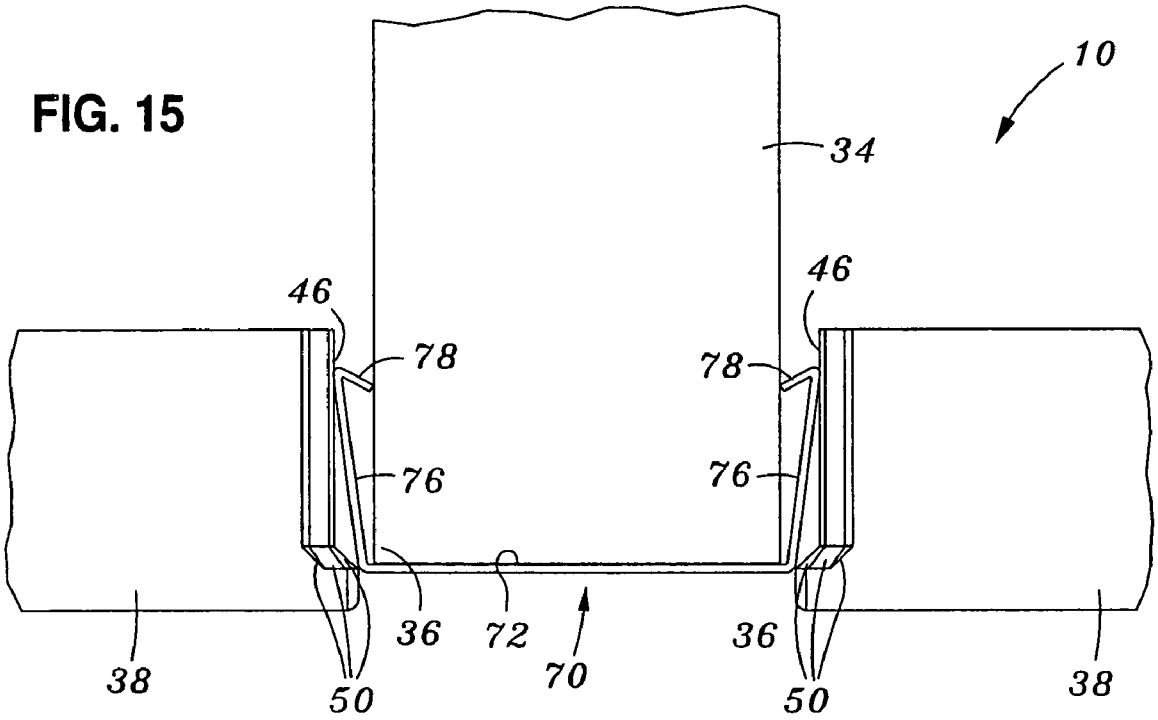
FIG. 15 is an enlarged end view of the side anvils prior to direct engagement with the structural member.
Figure 16:
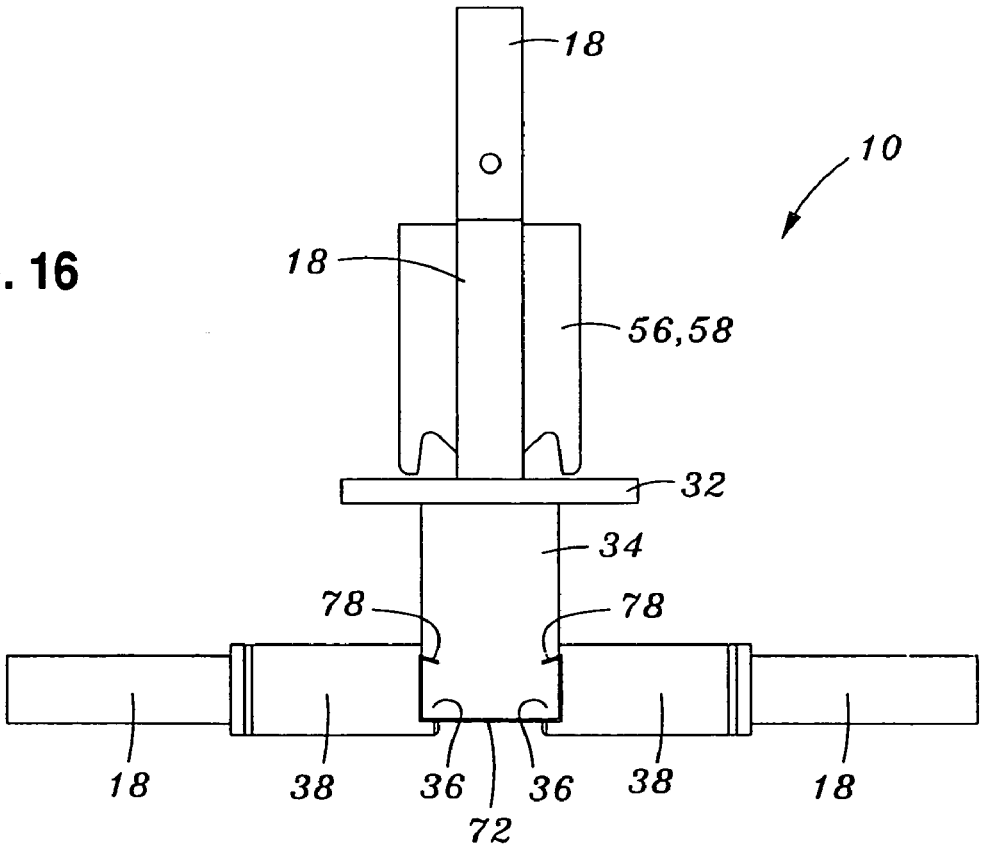
FIG. 16 is an end view of the side anvils and mid anvil directly engaged to the structural member to form the joining profile thereinto while the cutting blade is retracted.

FIG. 14 illustrates the side anvils 38 initially engaged to the flanges 76 while the cutting assembly 56 is shown retracted away therefrom. FIG. 15 illustrates a close-up of the relative positioning of the side anvils 38 with the flanges 76. FIG. 16 illustrates the direct engagement of the side anvils 38 and mid anvil 34 with the structural member 70 in order to effectuate introduction of the joining profiles 84 in the structural member 70. The cutting assembly 56 may be advanced toward the structural member 70 whereby the cutting blade 58 may descend in order to subdivide the structural member 70 into separate pieces. The resulting cutting operation results in ends of each of the separate pieces including separate joining profiles 84. It should be noted that although the step of cutting is illustrated as being performed after introduction of the joining profiles 84, cutting of the structural member 70 may be performed prior to or after introduction of the joining profiles 84.

It should be noted that the cutting assembly 56 is preferably configured to be moveable in an orientation transverse to the longitudinal axis 94 of the structural member 70 whereby the cutting blade 58 may be advanced toward the structural member 70 while the web 72 is clamped between the forming body 26 (i.e., mid anvil 34) and the base member 20. Furthermore, the forming assembly 10 is preferably configured such that the structural member 70 is cut such that the joining profiles 84 are located proximate an end 90 of the members.

Advantageously, the anvil profiles 46 preferably include ramped surfaces 50 as was earlier described in order to facilitate introduction of the joining profiles 84 into the structural member(s) 70. The ramped surfaces 50 cause excess material to fold and deform in localized areas of the structural members 70 as the side anvils 38 advance toward the flanges 76. The unique geometry of the formations 48 (i.e., the ramped surfaces 50) alone of in combination with the protrusions 44 provides a means to enable compression of material which allows for appropriate metal stretching and enables introduction of the joining profiles 84 without over-stressing and/or inducing cracking or unwanted deformations of the material. More specifically, such ramped surfaces 50 and protrusions 44 relieve undue material stresses during formation of the joining profiles 84. In this manner, the ramp surfaces, the protrusions 44 as well as the flange returns 78 enhances the structural integrity of the finished product.

The above description is given by way of example, and not limitation. Given the above disclosure, one skilled in the art could devise variations that are within the scope and spirit of the invention disclosed herein including various ways of forming the joining profile 84. Furthermore, the various features of the embodiments disclosed herein can be used alone or in varying combinations with each other and are not intended to be limited to the specific combination described herein. Thus, the scope of the claims is not to be limited by the illustrated embodiments.

What is claimed is:

1. A method of forming a joining profile in a stud member for a wall such that the stud member may detachably engage a horizontal member having a corresponding mating profile, the method comprising the steps of:

a) providing a forming assembly having a base member and including a forming body and at least one side anvil having at least one anvil profile formed therein and a protrusion disposed adjacent to the anvil profile;

b) mounting the stud member on the base member, the stud member having a web and at least one flange extending generally perpendicularly from the web;

c) advancing the forming body toward the stud member until the web is clamped between the forming body and the base member;

d) urging the side anvil toward an external face of the flange along a first direction substantially perpendicular to a plane of the flange;

e) engaging the anvil profile to the flange for forming the joining profile in the flange, the joining profile having a gender opposite that of the anvil profile; and f) during the engaging the anvil profile to the flange step, engaging the protrusion with the web, the protrusion pushing a portion of the web in a second direction which is substantially perpendicular to the first direction for accommodating formation of the joining profile.

2. The method of claim 1 wherein the anvil profile is V-shaped and step (e) comprises forming a V-shaped joining profile.

3. The method of claim 1 wherein the protrusion is dome shaped.

4. The method of claim 1 wherein the protrusion is disposed on a seat supporting the side anvil Wherein the protrusion and the anvil profile extend generally perpendicular to each other.

5. The method of claim 1 wherein:

step (e) comprises forming the joining profile in one of parallel and normal orientations relative to a longitudinal axis of the structural member.

6. The method of claim 1 wherein:

the flange defines a height from the web;

step (e) comprises forming the joining profile along a substantial portion of the flange height.

7. The method of claim 1 wherein:

step (e) comprises forming the joining profile at a location proximate the web.

8. The method of claim 1 wherein:

step (e) comprises forming the joining profile at a location adjacent an end of the stud member.

9. The method of claim 1 wherein the stud member defines opposing ends, the flange and web extending along a longitudinal axis between the opposing ends, the method further comprising the step of cutting the stud member between the opposing ends.

10. A method of forming a joining profile in a structural member such that the structural member may detachably engage another member having a corresponding mating profile, the method comprising the steps of:

a) providing a forming assembly having a base member and including a forming body and at least one side anvil having at least one anvil profile formed therein and a protrusion disposed adjacent to the anvil profile;

b) mounting the structural member on the base member, the structural member having a web and at least one flange extending outwardly from the web;

c) advancing the forming body toward the structural member until the web is clamped between the forming body and the base member;

d) urging the side anvil toward an external face of the flange along a direction perpendicular to a plane of the flange such that the anvil profile engages the flange;

e) forming the joining profile in the flange, the joining profile having a gender opposite that of the anvil profile, the joining profile defining an inwardly directed recess configured to engage a corresponding profile of opposite gender in another one of the members; and f) engaging the protrusion with the web during urging of the side anvil toward the flange such that a portion of the web is forced upwardly by the protrusion to accommodate formation of the joining profile.

11. A method of forming a joining profile in a structural member such that the structural member may detachably engage another member having a corresponding mating profile, the method comprising the steps of:

a) providing a forming assembly having a base member and including a forming body and at least one side anvil having at least one anvil profile formed therein and a protrusion disposed adjacent to the anvil profile;

b) mounting the structural member on the base member, the structural member having a web and at least one flange extending outwardly from the web, the flange having an external face and an internal face;

c) advancing the forming body toward the structural member until the web is clamped between the forming body and the base member;

d) urging the side anvil toward an external face of the flange along a direction perpendicular to a plane of the flange such that the anvil profile engages the flange;

e) forming the joining profile in the flange, the joining profile having a gender opposite that of the anvil profile, the joining profile defining a recess formed in the external face and a projection formed opposite the recess in the internal face; and f) engaging the protrusion with the web during urging of the side anvil toward the flange such that a portion of the web is forced upwardly by the protrusion to accommodate formation of the joining profile.

12. A method of forming joining profiles in a channel shaped structural member such that the structural member may detachably engage another member having corresponding mating profiles, the structural member defining a longitudinal axis and having a web and a pair of opposing flanges extending outwardly from the web, the method comprising the steps of:

a) providing a forming assembly having a base member and including a forming body having a mid anvil with V-shaped anvil profiles formed on opposing faces of the mid anvil, the forming assembly further including a pair of side anvils each having V-shaped anvil profiles formed complementary to the anvil profiles of the mid anvil, each one of the side anvils further including at least one protrusion disposed adjacent to the anvil profile;

b) mounting the structural member on the forming assembly by placing the web on the base member;

c) advancing the forming body toward the structural member until the web is clamped between the forming body and the base member;

d) urging the side anvils toward a corresponding one of the external faces along a direction perpendicular to a plane of the flanges such that the anvil profiles engage respective ones of the flanges;

e) forming a V-shaped joining profile in each one of the flanges by clamping the flanges between the mid anvil and the side anvils, the joining profiles having a gender opposite that of the anvil profiles; and f) engaging the protrusions with the web during urging of the side anvils toward respective ones of the flanges such that opposing portions of the web are forced upwardly by the protrusions at locations adjacent to each one of the joining profiles to accommodate formation of the joining profiles.

13. The method of claim 12 wherein:

step (e) comprises forming each of the joining profiles on opposing external faces at equal distances from the web.

14. The method of claim 12 wherein the protrusion is dome shaped.

15. The method of claim 12 wherein each of the protrusions is disposed on a seat mounted to a corresponding one of the side anvils.

16. The method of claim 12 wherein:

each one of the flanges has external and internal faces;

step (e) comprises forming the joining profiles such that each of the joining profiles defines an inwardly directed recess formed in the external face and a projection formed opposite the recess.

17. The method of claim 12 wherein:

step (e) comprises forming each of the joining profiles in one of a parallel and a normal orientation relative to the longitudinal axis.

18. The method of claim 12 wherein:

each one of the flanges defines a height from the web;

step (e) comprises forming the joining profiles along a substantial portion of respective ones of the flange height.

19. The method of claim 12 wherein the forming assembly further includes a retractable cutting blade, the method further comprising the step of:

g) cutting the structural member at an orientation transverse to the longitudinal axis by advancing the cutting blade toward the structural member while the web is clamped between the forming body and the base member.

20. The method of claim 19 wherein the structural member is cut such that the joining profiles are located proximate an end of the structural member.

* * * * *